United States Patent [19]

Naidus et al.

[11] 4,080,763

[45] Mar. 28, 1978

[54] SKYLIGHT FRAME CONSTRUCTION

[75] Inventors: Edward Sidney Naidus, Glen Rock; Charles Wheeler Clark, Dumont, both of N.J.

[73] Assignee: RCA Corporation, New York, N.Y.

[21] Appl. No.: 766,563

[22] Filed: Feb. 7, 1977

[51] Int. Cl.[2] ..... E04B 7/18

[52] U.S. Cl. ..... 52/200; 52/209

[58] Field of Search ..... 52/199–209

[56] References Cited

U.S. PATENT DOCUMENTS

| | | | |
|---|---|---|---|
| 3,012,375 | 12/1961 | Wasserman | 52/22 |
| 3,731,442 | 5/1973 | Kiyoshi | 52/232 |
| 3,788,013 | 1/1974 | Veen, Jr. | 52/200 X |
| 3,918,226 | 11/1975 | Naidus | 52/200 X |
| 3,969,858 | 7/1976 | Naidus | 52/200 X |
| 3,996,844 | 12/1976 | Leurent | 52/200 X |

FOREIGN PATENT DOCUMENTS

| | | | |
|---|---|---|---|
| 339,366 | 8/1959 | Switzerland | 52/209 |

*Primary Examiner*—Ernest R. Purser
*Assistant Examiner*—Carl D. Friedman
*Attorney, Agent, or Firm*—H. Christoffersen; Samuel Cohen; William Squire

[57] ABSTRACT

A frame supporting the dome of a skylight is formed with conduits along the outer peripheral edges of the flange at the base of the dome, receptive of water runoff from the dome. The conduits are formed with openings for conducting the water to the outside of the curb on which the frame is mounted. When, due to heavy precipitation, or for other reason, some of the runoff water passes under the lower surface of the flange of the dome, it passes over the inner lip of frame members on which the flange rests and into a second conduit below the first which conducts this portion of the runoff also to the outside of the curb and away from the opening within the curb over which the skylight is positioned.

11 Claims, 4 Drawing Figures

SKYLIGHT FRAME CONSTRUCTION

Figure 1:
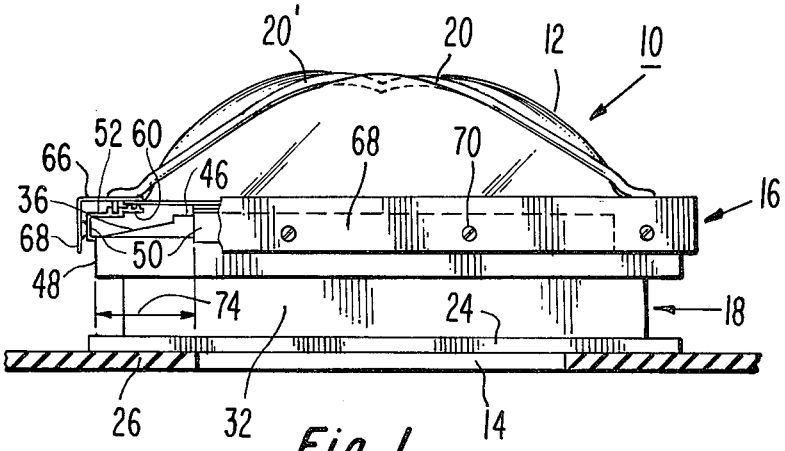

The present invention relates to frame structures for mounting a skylight structure to a curb.

Thermoplastic skylights are achieving wide-spread use as heat responsive fire vent apparatus. Such apparatus are disclosed in the U.S. Pat. Nos. 3,918,226 and 3,731,442. In response to sufficient heat generated by a fire, the thermoplastic skylight member softens and shrinks and this causes it to slip out of its mounting frame and to fall into the building opening. To insure such operation, that is, the disengagement of the skylight member, it is held only loosely to the curb — the peripheral flange of the skylight member is permitted to float within its supporting frame. This form of mounting is not completely water-tight, the relatively large openings between the flange and the frame often permitting water resulting from rain or snow to enter the building.

There is a need, in the present art, for a frame which will securely mount a thermoplastic skylight member to a curb under normal ambient conditions, which will permit the skylight member to disengage in the presence of elevated temperatures within the building, and which will prevent the water runoff which occurs during precipitation from entering the building. The structure embodying the present invention is designed to meet this need.

IN THE DRAWING

Figure 2:
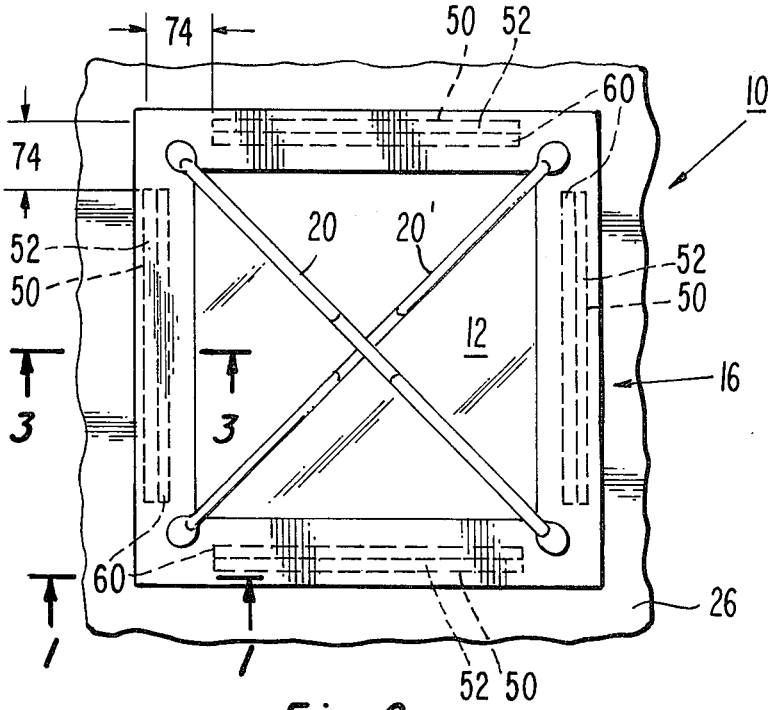
Figure 3:
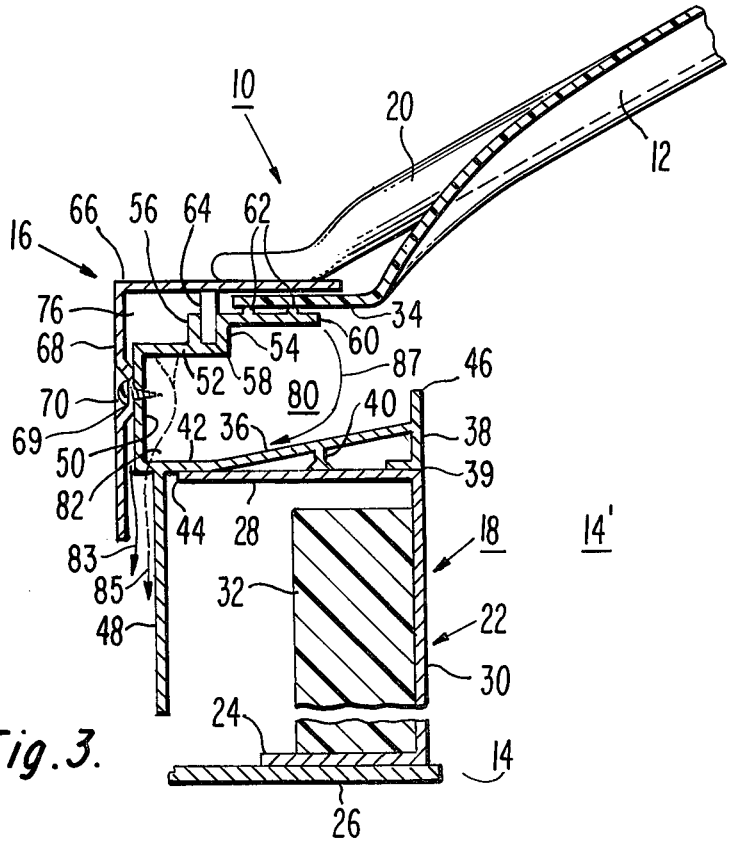
Figure 4:
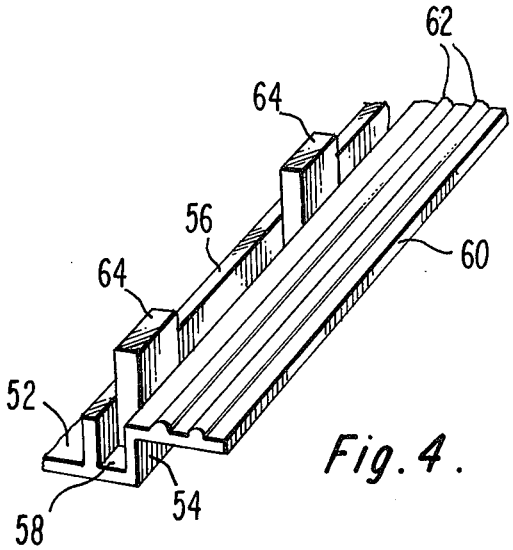

FIG. 1 is a side elevational view of skylight structure embodying the present invention, FIG. 2 is a plan view of the skylight structure of FIG. 1, FIG. 3 is a sectional view of the structure of FIG. 2 taken along lines 3—3, FIG. 4 is an isometric view of a portion of the frame structure used in the embodiment of FIGS. 1, 2, and 3.

In FIGS. 1 and 2, skylight structure 10 includes a thermoplastic heat responsive fire vent dome 12 of the type described in U.S. Pat. No. 3,918,226 issued to the present applicant. Dome 12 is one which in response to elevated temperatures which may exist within a building upon the occurrence of a fire softens, shrinks out of the supporting frame structure 16, and falls into the opening 14 in the building, the opening 14 thereafter serving as a heat and smoke vent. The dome 12 is releaseably secured to supporting frame 16. The supporting frame structure 16 is mounted to curb assembly 18. A pair of cross braces 20 and 20′ are welded to the corners of frame structure 16 on the upper surface thereof and extend over the dome 12. The cross braces 20 and 20′ serve as a personnel safety apparatus. The skylights of FIGS. 1 and 2 are shown square but may be of any suitable shape.

Frame structure 16 is mounted on curb assembly 18 which includes a upstanding channel member 22 (FIG. 3) which has a horizontal leg 24 secured to the horizontal roof 26 of a building. A second horizontally extending leg 28 extends outwardly from the upper edge of the upstanding leg 30. Mounted on the outer portion of channel member 22 is suitable insulation 32 secured between legs 24 and 28 to the upstanding wall 30.

Structure 16 is mounted on the upper surface of leg 28. The frame structure 16 secures the dome 12 flange 34 which extends around the dome periphery. Structure 16 includes a bottom wall 36 which extends outwardly from the opening 14′ formed by leg 30 and downwardly towards leg 28. The innermost edge of wall 36 is supported on leg 28 by spacer legs 38 and 40 which abut leg 28. Leg 38 is tack welded to wall 30 at the joint 39 therebetween. The outer peripheral horizontal portion 42 of bottom wall 36 rests directly on leg 28, the sloping portion of wall 36 joining this horizontal portion before the outer edge 44 of leg 28 is reached. An upstanding gutter wall 46 extends upwardly from the inner edge of bottom wall 36. A downwardly depending apron 48 is secured to the portion 42 of bottom wall 36. Bottom wall 36, gutter 46 and apron 48 extend continuously around opening 14′.

Four spaced upstanding walls 50 fixed to the outer edge of bottom wall 36 extend upwardly therefrom. There is one wall 50 (dashed-FIG. 2) on each of the sides of the skylight structure 10. Walls 50 are approximately centrally disposed on each side of the skylight. Extending inwardly from the upper edge of each wall 50 is an upper cantilevered wall 52. Formed on the upper surface of wall 52 are a pair of upstanding parallel legs 54 and 56 (shown in both FIGS. 3 and 4) which form a channel 58 therebetween. Extending inwardly from the uppermost edge of leg 54 is a cantilevered dome flange supporting lip 60. Lip 60 includes a pair of spaced parallel ridges 62 running along the length of the lip 60 parallel to the opening 14′. The top edge of ridges 62 is higher than the top edge of leg 56. Flange 34 rests on the upper edge of each of the ridges 62 and is spaced from the upper surface of lip 60. Disposed at spaced locations along the length of channel 58 are a plurality of spacers 64. Spacers 64 may be any suitable spacing members which fit snugly in channel 58 between legs 54 and 56. Spacers 64 extend beyond lip 60 in the upward direction a distance greater than the upper surface of flange 34. Several spacers 64 may be disposed in channel 58 on each side of the skylight. Resting on spacers 64 is outer apron leg 66 which extends horizontally from the upper edge of leg 68 which forms an angled member therewith. Leg 68 is juxtaposed with and secured spaced from outer wall 50 via screws 70. In the alternative, leg 66 may be screwed to channel 58 between spacers 64 instead. Leg 68 is spaced from wall 50 to permit drainage of water between wall 50 and leg 68. As shown in FIG. 3, leg 68 is formed with spaced inwardly extending bosses 69, each such boss including an opening at its center for a screw 70. In the regions between screws, the leg 68 and wall 50 define between the drainage passages for conducting away water tending to accumulate in cavities 76, as indicated schematically by arrow 83.

As best seen in FIGS. 1 and 2, walls 50, upper walls 52 and lips 60 being centrally disposed on each side of the skylight structure are spaced a distance indicated by 74 from the respective edges of the skylight structure sides. That is, walls 50 are discontinuous around the skylight periphery.

In operation, rainfall reaching the dome 12 flows over the upper surface of flange 34, FIG. 3, between flange 34 and leg 66. The water then flows between spacers 64 and into the cavities 76 formed between the respective legs 68 and 56, and having as their base the wall 52. The volume of each of cavities 76 is relatively large as compared to the volume of rain water runoff that may flow between flange 34 and leg 66 of the outer apron and the discharge rate of the cavity is relatively high. These design characteristics usually insure that the level of water in cavity 76 is below the top of leg 56 and so this water normally does not flow back between flange 34 and lip 60. The water in each of the four cavities 76 (one on each side of the skylight) flows downward in the drainage passage between legs 68 and walls 50 between bosses 69, direction 83, and also can flow along the length of each cavity 76 to the ends of each cavity (at spacings 74). There (at the cavity ends) the water spills directly onto wall 36. Rain water reaching the upper surface of the bottom walls 36 flows directly over the outer edges thereof between legs 68 of the outer apron and aprons 48 (FIG. 3) at the skylight structure corners through spacings 74 between walls 50 (direction 85).

The above is a first drainage mode. However, it sometimes occurs that some of the runoff from the dome 12 may reach the region of the lip 60 on which the supporting ridges 62 are formed. This can happen for a number of reasons. For example, if the dome 12, which is a thermoplastic member and which may have imperfections therein, has a warped flange the free edge of which is higher than the inner region of the flange, water may run along the lower surface of the flange to the space between lip 60 and flange 34. In the case of heavy or violent precipitation, the turbulent flow of water may cause splashing into this region. Also, if the runoff from the dome is sufficiently heavy, the runoff rate from the cavity 76 may be insufficient to prevent the water level from climbing over the leg 56 and ridges 62 and entering the space between lip 60 and flange 34. Runoff water which reaches the region between the inner one of ridges 62 and lip 60 spills over the lip and directly onto wall 36, direction 87. The downwardly sloping wall 36 then drains the water to the outer edge of wall 36. The water then flows along the channel formed by walls 50, wall 36 and horizontal portion 42 to the spacings 74 at the ends of walls 50 where the water drains between leg 68 and apron 48 in a direction similar to direction 85.

In prior art devices as illustrated in U.S. Pat. No. 3,918,226, runoff between the dome flange and the supporting lip may leak into the building opening 14. This leakage was determined to be caused by insufficient drainage of the runoff between the flange and the supporting lip. The water tends to overflow the channel formed by the gutter and the upstanding wall supporting the skylight flange. To provide large exit holes in the upstanding wall of the prior art frame wound tend to weaken the upstanding wall supporting the skylight. Such a problem has been overcome by the frame construction of the present invention by providing an enlarged drainage cavity 80 and rapid runoff therefrom, the cavity being formed by the bottom wall 36, upstanding wall 50, and wall 46 (the effective top of the cavity being defined by the top edge of gutter 46). The cavity 80, FIG. 3, is disposed above the entire curb assembly 18 and may in fact extend beyond the curb assembly as shown at 82. The relatively large cavity 80 permits drainage water to flow towards the corners of the skylight structure and drain through the large openings provided by spacings 74 without leakage into the building while maintaining a structurally sound support for the skylight. Runoff water of the prior art structures tends to accumulate in the relatively smaller drainage channels corresponding to channel 80 in the present embodiment, causing leakage into the building opening.

In the present structure the downward sloping wall 36 helps to drain any water which may be present to the outer peripheral region (over portion 42 of wall 36) of the frame construction 16 and away from opening 14. As can be seen in FIG. 3, the cavity 80 has a channel cross-sectional area defined by gutter 46, wall 36 and wall 50 that is much greater than the channel area of cavity 76 formed by walls 56, 68 and 52. Both cavities 76 and 80 have bottom walls situated below flange 34 to permit rapid drainage. The drainage rate from cavity 80 is made sufficiently great to accomodate overflow from cavity 76 or other leakage under flange 34 without spilling over gutter 46 into opening 14'.

The frame construction 16 may be conveniently formed to two extruded aluminum members. One member forms legs 66 and 68 of the outer apron and the other member forms the remainder of the frame construction comprising walls 36, 50, 52, and lip 60. Spacers 64 provide a relatively inexpensive means for securing the outer apron member directly to the upper wall 52. The direct securing of leg 66 of outer apron member via spacers 64 to upper wall 52 insures that flange 34 is spaced from leg 66 at all times. This prevents any binding of the flange 34 during the heat and smoke venting action of the dome 12.

What is claimed is:

1. In a skylight for enclosing an opening in a building, the skylight including a curb surrounding the opening, the curb including a flange extending outwardly from the opening, a frame secured to the flange, and a skylight dome member releasably secured to the frame, the frame comprising:

a bottom wall disposed above the flange and extending outwardly from an inner edge adjacent the opening and sloping downwardly from its inner edge toward the flange, a plurality of spaced outer upstanding walls extending from the outer edge of said bottom wall, an inwardly extending upper wall cantilevered from each said outer upstanding walls, an inwardly extending dome member supporting lip cantilevered from and spaced above each said upper wall, a plurality of spaced apron support members disposed on each said upper wall between said lip and said upstanding wall, said support members extending above said lip, and an outer apron including first and second legs, said first leg extending inwardly and located spaced from said upper wall and lip by said support members, said second leg depending downwardly from said first leg and secured spaced from and to said outer upstanding walls.

2. In the skylight of claim 1 wherein said frame further includes an inner apron depending downwardly from said bottom wall at the outer edge of said flange.

3. In the skylight of claim 1 wherein said upper wall includes an upstanding lip supporting wall extending from the upper wall inner edge, said lip extending from the upper edge of said lip supporting wall, a second upstanding wall extending from said lip supporting wall and forming a channel therewith, said channel being adapted for receiving said support members.

4. In the skylight of claim 1 wherein said bottom wall includes at least one downwardly depending support leg for spacing the bottom wall inner edge from the flange.

5. In the skylight of claim 1 wherein said lip has an inner edge terminating spaced above said bottom wall intermediate the inner and outer edges of said bottom wall.

6. A frame for securing a skylight dome having an outwardly extending flange at its base over an opening in a building or other structure, said opening defined by a raised curb which surrounds the opening comprising, in combination:

a first member in fixed position relative to the curb on which said flange is adapted to rest;

a second member over the first, also in fixed position relative to the curb which, when the dome is in place, extends over the upper surface of the flange and loosely holds the flange in place, the two members, between them defining a passage through which water running off the exposed surface of the dome may pass, and the first member terminating at its inner peripheral edge beyond said opening and being formed also with an outer peripheral edge;

first conduit means formed as an extension of the first member positioned to receive the water passing over the outer peripheral edge of said first member, said first conduit means formed with an opening outside said curb for discharging the water it receives, outside of said curb and outside of the second conduit means set forth below; and second conduit means below the first positioned to receive water which passes over the inner peripheral edge of said first member, said second conduit means being formed with opening means outside said curb for discharging water therefrom outside of said curb.

7. A frame for securing a skylight dome having an outwardly extending flange at its base over an opening in a building or other structure, the opening being surrounded by a raised curb comprising, in combination:

first conduit means along the outer peripheral edge of the flange for receiving water runoff from the dome, the conduit means having openings therein outside of the curb for the discharge of the water it receives outside of the second conduit means set forth below, and said conduit means having an inner peripheral edge over which water spills when the runoff rate exceeds its discharge rate for a time sufficient to fill the conduit means over its capacity; and second conduit means below the first positioned to receive water which spills over the inner peripheral edge of the first conduit means and to discharge the same via openings therein outside of the curb.

8. In a skylight having a curb, a frame supported by the curb, and a dome releasably supported by the frame, in which the dome has a flange at its base and the frame has a member on which the flange rests, and improved frame structure for lessening the tendency of any water runoff from the frame from passing into the opening defined by the curb comprising, in combination:

first conduit means along the outer edge of the flange having openings outside the curb, said conduit means receiving the runoff water from the dome and having sufficient capacity and discharge rate via said openings normally to discharge the runoff water to a region outside of the curb and outside of the second conduit means set forth below; and second conduit means below the first conduit means positioned to receive water flowing over the inner edge of the member on which the flange rests for receiving water which flows between the flange and said member and discharging the same outside of said curb.

9. In the combination of claim 8 wherein said first conduit means includes a plurality of spaced conduits, each conduit including a first water discharge opening along the length of that conduit, each conduit terminating at its respective ends in a second water discharge opening.

10. In the combination of claim 8 wherein said second conduit means includes a plurality of spaced conduits, each said spaced conduit terminating at its respective ends in a water discharge opening.

11. In the combination of claim 8 wherein said skylight dome includes a rectangular flange, said first conduit means including a plurality of first conduits, each said first conduits being formed along the outer edge of said flange on a side of the dome, each conduit having open ends for discharging water, said second conduit means including a like plurality of second conduits each beneath a corresponding first conduit, the second conduits being open at the respective ends thereof for discharging water, the ends of said first and second conduits being coextensive.

* * * * *